US005478028A

United States Patent [19]

Snyder

[11] Patent Number: 5,478,028

[45] Date of Patent: Dec. 26, 1995

[54] TRACKING AND GUIDANCE TECHNIQUES FOR SEMI-BALLISTIC ROUNDS

[75] Inventor: John L. Snyder, Garland, Tex.

[73] Assignee: Texas Instruments Incorporated, Dallas, Tex.

[21] Appl. No.: 259,977

[22] Filed: Oct. 7, 1988

Related U.S. Application Data

[63] Continuation of Ser. No. 588,608, Mar. 12, 1984, abandoned.

[51] Int. Cl.[6] ..... F41G 7/00

[52] U.S. Cl. ..... 244/3.11; 244/3.22

[58] Field of Search ..... 244/3.11, 3.22

[56] References Cited

U.S. PATENT DOCUMENTS

| | | | |
|---|---|---|---|
| 3,860,199 | 1/1975 | Dunne | 244/3.22 |
| 4,003,659 | 1/1977 | Conard et al. | 244/3.11 |
| 4,097,007 | 6/1978 | Fagan et al. | 244/3.11 |
| 4,300,736 | 11/1981 | Miles | 244/3.22 |

*Primary Examiner*—Charles T. Jordan
*Assistant Examiner*—Theresa M. Wesson
*Attorney, Agent, or Firm*—René E. Grossman; Richard L. Donaldson

[57] ABSTRACT

A semiballistic projectile system is disclosed. The system includes a semiballistic projectile ground tracking and rangefinding system that selectively transmits course correction and rangefinding signals. The semiballistic projectile has a pyroelectric detector that includes a reflecting portion, nonreflecting portion, and a focusing lens for focusing electromagnetic signals onto the pyroelectric detector adjacent to its periphery. The reflecting port ion operates by reflecting impinging electromagnetic signals as return signals for orienting course corrections and the nonreflecting portion receives and decodes coded course correction signals for a jet thrust or other steering apparatus which corrects the projectile's course to a target.

18 Claims, 3 Drawing Sheets

TRACKING AND GUIDANCE TECHNIQUES FOR SEMI-BALLISTIC ROUNDS

This application is a Continuation of application Ser. No. 06/588,608, filed Mar. 12, 1984, now abandoned.

This invention relates to fire control systems and more particularly to a command adjusted trajectory fire control system and a semiballistic projectile therefor.

In the past cannon launched guided projectiles have included a tubular housing having a stabilization section at the aft end and proceeding forward from the aft end to the front end a payload section, a control section, an electronics section and a gyro-optical section. The stabilization section includes a plurality of stabilizing fins which in the firing position are held flush with the housing by friction latches When the spinning projectile leaves the cannon barrel the centrifugal force overcomes the friction force of the latches and the stabilizing fins are deployed to stabilize the projectile in flight for course correction. The control section actuators. The servo actuator are operated by the output signals of the guidance system.

The guidance system is responsive to the output of a target seeking gyro-optical assembly which is suitable for inclusion in the nose cone of the projectile. The gyro-optical assembly is responsive to light reflected from a target.

The disadvantages of such cannon launched guided projectiles are the cost, size and reliability of the complex mechanical and electro-optical structures and electronic circuits necessary for detecting and guiding the projectile which is enhanced greatly by the expendable nature of the self-contained projectile.

Nevertheless, projectiles of the "fire and forgot" type have a very low "first round hit" probability.

Accordingly it is an object of this invention to provide a low cost semiballistic projectile system.

Another object of the invention is to provide a semiballistic projectile system which can be utilized in small projectiles.

A further object of the invention is to provide a semiballistic projectile having a high "first round hit" probability;

Still another object of the invention is to provide a semiballistic projectile system having a ground based system means for ranging, tracking, and guiding a semiballistic projectile to a target.

Yet another object of the invention is to provide a semiballistic projectile system having an improved course correction subsystem including an exact spin position determining means for a spinning semiballistic projectile.

Briefly stated this invention comprises a command adjusted trajectory fire control system and a semiballistic projectile therefor. The command adjusted trajectory fire control system includes a ground based subsystem and a carrier based subsystem mounted in the semiballistic projectile. A semiballistic projectile for the purpose of this invention is a cannon launched body which is rotating about its longer axis during flight along its trajectory to a target. The body contains the carrier based subsystem which contains minimal parts to meet cost, size and weight constraints of small cannon rounds, e.g. forty millimeter rounds and above.

The carrier subsystem coacts with the ground based subsystem for orienting the trajectory correction commands to the spin of the projectile. Thereafter the carrier based subsystem decodes the trajectory correction commands, and activates thrusters or other steering means to change the trajectory of the projectile to the target.

The ground based subsystem establishes the line of sight and range to a target, computes an ideal trajectory to the target, tracks and ranges the projectile, compares the actual trajectory to the ideal trajectory, determines trajectory correction commands and the spin position of the projectile, and transmits the commands to the carrier subsystem.

Other objects and features of the invention will become more readily understood from the following detailed description and appended claims when read in conjunction with the accompanying drawings, in which like reference numerals designate like parts throughout the figures thereof and in which:

FIGS. 1*a* and 1*b* are block diagrams of the semiballistic projectile system showing in detail, respectively, the ground base subsystem and the carrier based subsystem.

FIG. 2*a* is a side view of the carrier based subsystem optics to sense roll.

FIG. 2*b* is a front view of the pyroelectric detector of the carrier based subsystem optics.

Figure 1A:
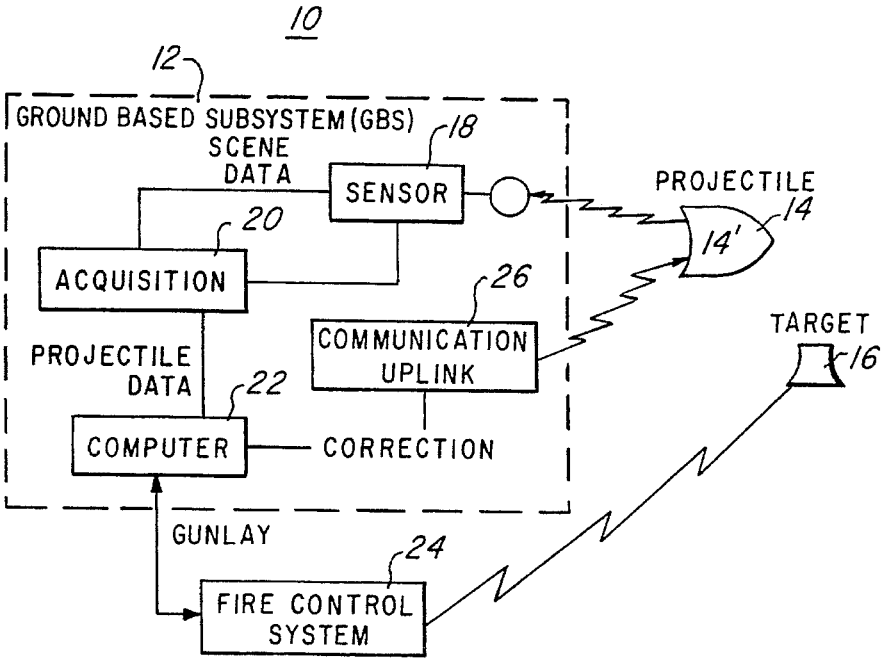
Figure 1B:
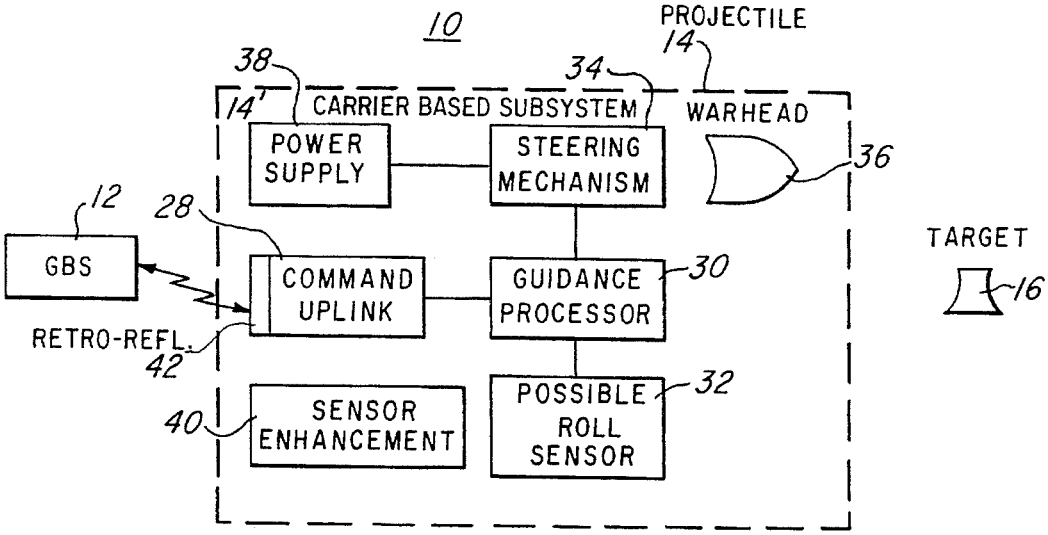

Referring now to FIGS. 1*a* and 1*b*, the command adjusted trajectory fire control system and semiballistic projectile 10 comprises a ground based subsystem 12 and a carrier based subsystem and semiballistic projectile 14 for guiding the projectile to a target 16.

The ground based subsystem 12 (FIG. 1*a*) comprises a sensor 18 which may be, for example, a microwave (radar) based or an infrared (IR) based detector and rangefinder system for describing the scene in which the projectile is located. An electronic projectile acquisition circuit 20 receives the scene data and determines the presence of the projectile and such important parameters as azimuth, elevation, magnitude, range and velocity, hereinafter, collectively referred to as projectile data. The actual trajectory of the projectile is computed by a computer 22.

A fire control system 24 determines the line of sight to the target and inputs this data together with ballistic type data including gunlay lead angle prediction information to the computer 22. The computer 22 which for example, is a microprocessor, using the closed form ballistic solutions, computes an ideal trajectory to the target and using the data of the electronic acquisition circuit, the actual trajectory of the projectile. An ideal trajectory is one that does not take into account unmeasured winds, variations in projectile aerodynamics and weight balance anomalies, and variations in target motion; such factors are treated as error signals producing the actual trajectory.

The computer 22 then compares the actual trajectory to the ideal trajectory and generates correction commands (instructions) for communication by a communication uplink 26 (transmitter) to the carrier based subsystem 14' of the semiballistic projectile 14. The communication uplink 26 or transmitter may be, for example, the laser of a laser rangefinder.

The carrier based subsystem 14' (FIG. 1*b*) comprises a command uplink 28 for receiving and decoding the command signals transmitted by the communication uplink 26 of the ground based subsystem 12. The command uplink 28 is, for example, a pyroelectric detector of a retro-reflector/detector. A guidance processor 30 is connected to the command uplink 28 and depending upon the selected structure of the retro-reflector/detector, to a roll sensor 32. The roll sensor 32, if used, determines the roll angle and generates a roll error signal. If roll sensing is not done on the projectile, then roll sensing must be accomplished by sensing the retro-return signals at the gun location. The guidance processor 30 combines the command signals and any roll signals and converts them to projectile trajectory adjust signals for a steering mechanism 34. The steering mechanism 34, which is, for example, a gas actuated thruster (gas squib or solenoid controlled gas bottle) or an actuated air foil, is connected to the guidance processor and actuated by the trajectory adjust signals to steer the projectile and its warhead 36 to the target 16. A source of power, power supply 38 is connected to the command uplink 28 and steering mechanism to supply power to the circuitry of the command uplink 28 and steering mechanism 34. A sensor enhancement means 40 may be necessary to enhance the projectiles sensor characteristics for small projectiles.

It will be appreciated that the projectile is spinning and therefore the timing of the issuance of commands to the steering mechanism is critical. Thus, the projectile must be oriented when the trajectory correction commands are issued.

Figure 2A:
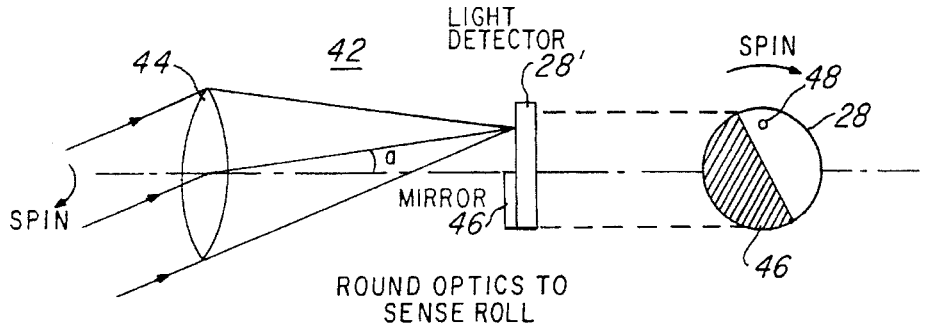
Figure 4:
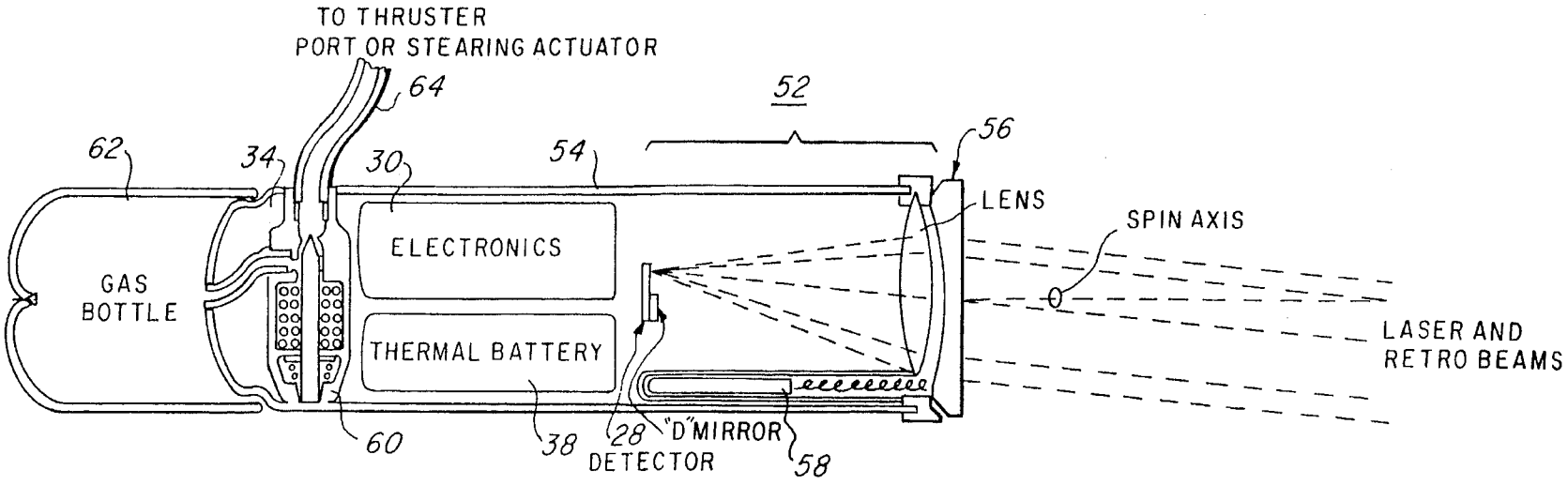
FIG. 4 is a partial view, partly in cross-section, of a projectile embodying a second embodiment of the carrier based subsystem.
Figure 5:
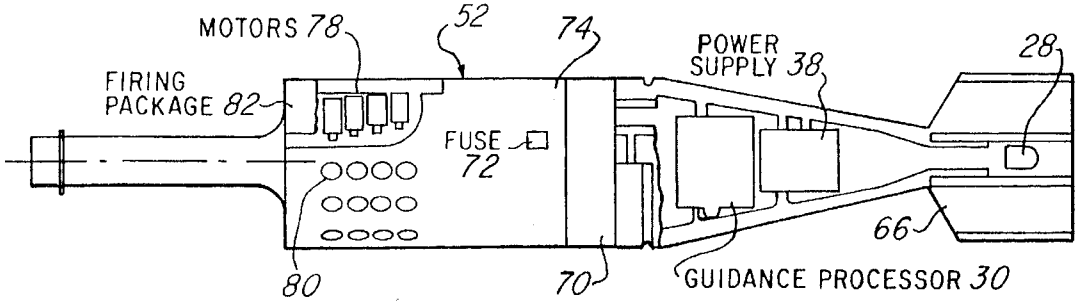
FIG. 5 is a view, partly in cross-section, of a projectile embodying a first embodiment of the carrier based subsystem.

When the ground based communication uplink 26 is, for example, an electromagnetic wave transmitter such as, for example, a $CO_2$ laser, the laser is operated first in a continuous wave (CW) mode for project, lie acquisition and orientation, and then in the pulsed mode for transmitting trajectory correction commands. A gyro-stabilized mirror is used, for example, to accurately point the laser beam. In the carrier subsystem, the retro-reflector/detector 42 (FIG. 2*a*) is attached to the aft end 52 of the projectile 14 (FIGS. 4 and 5). The retro-reflector/detector 42 is, for example, a focusing lens 44 and a retro-reflector 46 fixed to the command uplink 28 which is a light detector 28'. The retro-reflector 46 is, for example, a polarizer to provide enhanced roll sensing when used with a polarized uplink beam. If a $CO_2$ laser is used for the uplink then a wire-grid polarizer is appropriate but other polarizers could be used at other wavelengths. Neither a simple mirror nor plain polarizer will sense projectile roll correctly, however a patterned mirror either with or without the polarizer enhancement can sense roll correctly.

The light detector 28' is, for example, a pyroelectric detector, although other light detectors may be used depending on the wavelength of the uplink beam. Where the projectile can accommodate a cooler, detectors such as cooled HgCdTe, may be used to improve the detection capability substantially (about three orders of magnitude) over non-cooled pyroelectric detectors when operating with a $CO_2$ laser, for example.

Figure 2B:
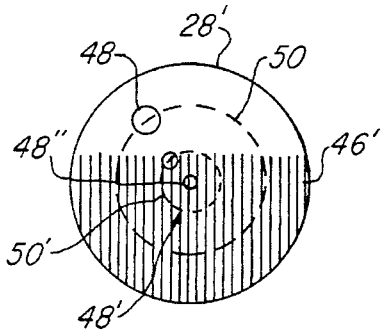

The surface of the light detector 28' is selectively covered by the mirror 46 to form a "D" shaped mirror covering a portion of the detector. The focusing lens 44 (FIG. 2*a*) at large angles between the projectiles spin axis and laser beam focuses the incoming laser beam to form a stationary spot 48 on the detector 28'. Thus with the detector rotating the spot 48 (FIG. 2*b*) traces the dashed pattern 50 around the surfaces of the detector and "D" shaped mirror, retro-reflector 46. For smaller offset angles the spot 48' approaches the center and the path 50' decreases. It will be appreciated that when the spin axis is aligned with the laser beam the spot 48" becomes centered and constrains orientation operation of the retro-reflector/detector. Thus, operation must take into account this constraint when a planned trajectory includes points of such alignment, as discussed later using a polarizer.

Figure 3:
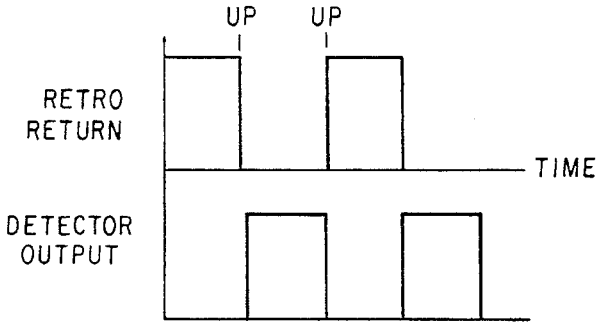
FIG. 3 is a time chart showing the phasing between retro return and detector output.

During illumination mirror, retro-reflector 46 (FIG. 2*a*) reflects the laser backwards to form a laser return signal; while the light detector 28' during illumination generates an electrical output. The phasing between the return signal and detector output is shown in FIG. 3. With the laser spot 48 (FIG. 2*a*) at the top of the projectile and the "D" mirror (FIG. 2*a*) covering half of the detector, during rotation from zero to 180 degrees the polarizer 46 receives the spot and the laser beam is retro-reflected to the ground based system. The ground based return signal detector sensor 18 (FIG. 1*a*) detects the reflected laser beam and outputs a voltage. While during rotation from 180 to 360 the light detector 28' receives the spot, the laser beam is not retro-reflected and the ground based return signal detector output is zero. Thus the retro-reflector returns the portion of the beam that it intercepts once per revolution of the projectile.

An alternate configuration (FIG. 2*b*) uses the polarizer enhancement to overcome the above-mentioned problem that occurs when the laser beam is exactly aligned to the projectile's spin axis. In this case, the D mirror is overlayed by a "D" shaped polarizer 46', with the "D" portion covering slightly more than half the detector circle so that the "on axis" case always causes the laser to impinge on the polarizer. When the laser beam and the spin axis are substantially misaligned, then the beam will alternately land on the light detector 28' (no reflection) and the polarizer (partial reflection) 46' and the ground based receiver can monitor the projectile spin as previously described above for the "D" mirror. However, when the laser beam and the spin axis become aligned, the return signal intensity waveform will be a sine wave whose frequency is twice the projectile spin rate. During the transition (as the spin axis moves into alignment with the laser beam) the ground based sensor will sense both the fundamental frequency (spin rate) and the second harmonic frequency (polarizer return).

The ground based sensor has a circuit to generate the half harmonic of the second harmonic frequency. The half harmonic is the projectile spin rate There is a 180° ambiguity inherent in generating this half harmonic waveform, but since the sensor has previously been tracking the fundamental spin frequency using the previously explained "D" chopper waveform, and since the half harmonic is the same frequency as the "D" chopped waveform, this allows the half harmonic to be phase locked to the spin frequency, thereby resolving the 180° ambiguity. This process is best done with a microprocessor that also has knowledge of the trajectory geometry.

If a $CO_2$ laser beam is used, then the polarizer may be a wire-grid polarizer which has the same reflective properties as a polarizer overlayed on a mirror, but it has the added advantage that the portion of the beam that is not reflected, is passed through to the detector allowing communication to the detector at this time.

When the projectile's spin axis is aligned with the laser beam, the modulated signal is detected by the ground based detector, sensor 18 (FIG. 1*a*) and the phase of the return signal indicates the spin attitude of the projectile except for the 180 degree ambiguity. The ambiguity is resolved whenever the spin axis of the projectile is offset in some known direction relative to the laser beam. For low velocity projectiles this is probably in the region of the apparent apogee when the body axis is tipped about 1 degree from the laser beam. For high velocity projectiles, this known offset direction occurs shortly after firing when the parallel between the gun and sight provide an offset of a known direction. Resolving the 180 degree ambiguity is a one time requirement as the spin rate of the projectile is substantially constant.

During the time the command uplink 28 (FIG. 1*b*) is receiving the laser beam, the laser of the ground based projectile tracker 26 may be pulsed to transmit coded trajectory correction signals to the command uplink 28. The command uplink 28 decodes the coded laser signal which may include "get ready" signals and on the next pulse executes the correction command signals.

Referring now to FIG. 4 in which is shown an electro-optical insert at aft end 52 containing the carrier based subsystem 14. The insert 52' includes a container 54 having its aft end 52 closed by a removable cover 56 for protecting the contents of the container during firing. The firing of the projectile 14 activates a spring actuated cover pusher 58 to remove the cover 56. The container houses the retro-reflector 46 (D mirror) and /detector 28, electronic guidance processor (electronic) 30, power supply thermal battery 38, and steering mechanism 34. The steering mechanism 34 includes solenoid actuated gas valve 60 connected to a gas bottle 62. Electrical power for the solenoid is provided by the thermal battery 38. When the valve is opened gas flows from the gas bottle through conduct 64 to a thruster (not shown) on the projectile.

In a second embodiment (FIG. 5) the projectile casing serves as the container 54. The retro-reflector 46, the command uplink 28 is mounted in the finned section 66 at the aft end of the projectile followed progressively to the forward end by the power supply 38, guidance processor 30, obturation band 70 and base-detonating fuse 72, warhead 74, squib impulse maneuvering motors 78 and gas ports 80, and electronic motor firing package 82. In this embodiment the squib motors 78 are selectively fired to generate gas for the corresponding ports 80 to provide the trajectory correction maneuvering force.

Although preferred embodiments of the present invention have been described in detail, it is to be understood that various changes, substitutions, and alterations can be made therein without departing from the scope of the invention as defined by the appended claims.

What is claimed is:

1. A command adjusted trajectory fire control system comprising:

a semiballistic projectile for hitting a target;

a first system means for ranging, tracking, the semiballistic projectile to the target and for issuing course correction commands to the semiballistic projectile, said first system means including;

a laser means for accurately pointing a laser beam to a first end of the semiballistic projectile which when struck will reflect the laser beam to generate laser returns, the semiballistic projectile has a spin associated with it when in flight and includes means for encoding spin data in the laser return, a tracker for using laser returns to track the semiballistic projectile, a target tracker means for maintaining a line of sight reference to the target to provide target tracking data thereby, and a data processor means for determining orientation of the projectile by the encoded spin data, for processing the target tracking data into an actual and an ideal trajectory to target, for comparing the actual and ideal trajectories and for generating steering commands from the comparison of the actual and ideal trajectories; and a second system means associated with the semiballistic projectile and wherein the means for encoding spin data includes a retro-reflector means mounted on the first end of the semiballistic projectile for selectively reflecting the laser beam to provide laser returns for projectile spin position orientation, the second system means additionally includes a detector means for detecting the laser steering commands of the first system means, and a steering control means for providing a course correction to the projectile in response to the steering commands.

2. The command adjusted trajectory fire control system according to claim 1 wherein the laser means is a $CO_2$ laser.

3. The command adjusted trajectory fire control system according to claim 1 wherein the target tracker means is a forward looking infrared tracking system.

4. The command adjusted trajectory fire control system according to claim 1 wherein the target tracker means is a quadrant detector target tracker.

5. The command adjusted trajectory fire control system according to claim 1 wherein the data processor means is a microprocessor.

6. The command adjusted trajectory fire control system according to claim 1 wherein the retro-reflector means includes an optical system having a focusing means for focusing incoming laser signals and a detector means including a selectively shaped mirror at an image plane for selectively reflecting the laser beam for providing the projectile spin orientation of the semiballistic projectile.

7. The command adjusted trajectory fire control system according to claim 1 wherein the retro-reflector means includes a detector selectively covered by a reflective polarizer means for providing the projectile spin orientation of the semiballistic projectile.

8. The command adjusted trajectory fire control system according to claim 7 wherein the reflective polarizer means is a wire-grid polarizer.

9. A system which determines attitude information for a projectile as it progresses along a trajectory to a target, the projectile having fore and aft portions positioned along a longitudinal spin axis, said system comprising:

a first subsystem capable of illuminating the projectile with radiation; and a second subsystem including an optical system located in the aft end of the projectile for receiving radiation from the first subsystem, said optical system comprising a focusing portion for directing the radiation along an optical path parallel with the spin axis and a plate positioned in the optical path to selectively transmit or reflect radiation during projectile progression, the transmitted or reflected radiation including encoded information indicative of projectile orientation about the spin axis.

10. The system of claim 9 wherein the plate transmits and reflects radiation during projectile progression, and the first subsystem is capable of determining target and projectile range.

11. The system of claim 9 wherein:

the plate is positioned to selectively reflect radiation to encode temporal information indicative of projectile orientation about the spin axis; and the first subsystem is capable of tracking the projectile based on reflected radiation and capable of providing guidance information for altering the projectile trajectory.

12. The system of claim 11 wherein the first subsystem is capable of determining the spin attitude of the projectile and provides trajectory adjust signals based on projectile spin attitude.

13. The system of claim 9 wherein the first subsystem includes a $CO_2$ laser for illuminating the projectile.

14. The system of claim 9 wherein the first subsystem includes a forward looking infrared system for tracking the target.

15. The system of claim 9 wherein the plate of the second subsystem is a patterned mirror.

16. The system of claim 15 wherein the first subsystem provides polarized radiation and the second subsystem further includes a wire-grid polarizer positioned in the optical path to provide enhanced information indicative of the projectile orientation.

17. The system of claim 9 wherein the focusing portion includes a refractive lens positioned to focus the radiation upon the plate.

18. The system of claim 9 wherein:

the first subsystem is capable of providing guidance information to the projectile by modulating the radiation;

the plate includes a transmissive portion and a reflective portion; and the second subsystem further includes a light detector positioned along the optical path to receive guidance information transmitted through the plate.

* * * * *